US006151758A

United States Patent [19]

Chiu

[11] Patent Number: 6,151,758

[45] Date of Patent: Nov. 28, 2000

[54] HANDLE ASSEMBLY FOR CONNECTING RESILIENT ROPES

[76] Inventor: Ciber Chiu, No. 407, Sec. 3, Luho Rd., Lukang Chen, Changhua Hsien, Taiwan

[21] Appl. No.: 09/288,374

[22] Filed: Apr. 5, 1999

[51] Int. Cl.[7] ..... A45F 5/10; A45C 13/22

[52] U.S. Cl. ..... 16/443; 16/442; 16/446; 16/444; 24/136 R

[58] Field of Search ..... 16/444, 443, 442, 16/445, 446; 24/115 L, 136 R, 136 A; 482/126, 125, 121; 403/122, 76

[56] References Cited

U.S. PATENT DOCUMENTS 4,762,318 8/1988 Phillips et al. ..... 24/115 L
5,454,140 10/1995 Murai ..... 24/136 R
5,681,248 10/1997 Vani ..... 482/126
5,873,805 2/1999 Ayres et al. ..... 482/125
5,885,196 3/1999 Gvoich ..... 482/125

*Primary Examiner*—Chuck Y. Mah
*Attorney, Agent, or Firm*—William E. Pelton

[57] ABSTRACT

A handle assembly includes a ring-shaped body which has three tapered passages defined radially therethrough, each passages having a large diameter opening defined in the inside of the handle and a smaller diameter opening defined in the outside of the handle. A resilient rope extends through at least one of the tapered passages. A locking device has a teardrop member and a shank extending from the teardrop member. The shank has a collar connected thereto, and the collar has a clamping member movably engaged therewith. The resilient rope in the tapered passage is securely held by the teardrop member. The resilient rope extends through the collar and is engaged by the clamping member.

7 Claims, 7 Drawing Sheets

HANDLE ASSEMBLY FOR CONNECTING RESILIENT ROPES

FIELD OF THE INVENTION

The present invention relates to a ring-shaped handle assembly which includes at least two tapered passages defined radially through the handle and at least one locking device removably received in at least two tapered passages. Each passage allows a resilient rope to extend therethrough that is securely held by a locking device in the passage.

BACKGROUND OF THE INVENTION

A conventional handle structure known to applicant is disclosed in U.S. patent application Ser. No. 09/059,643 to applicant, with the title "Handle Structure For A Chest Pull" and the filed on Apr. 4, 1998 now U.S. Pat. No. 5,894,631. The application is for an invention patent and discloses two ring-shaped handles with a resilient member connected therebetween so that a user pulls the two handles in opposite directions to exercise muscles. Each of the handles has a tapered passage, and a locking device is received in the tapered passage to secure the resilient member. Although the length of the resilient members between the two handles can be adjusted by adjusting the two locking devices in the two respective tapered passages in the two handles, the tension force of the resilient member cannot be adjusted because the total length of the resilient member is limited. Unless the resilient member is changed, the tension force of the resilient member of the chest pull cannot meet the requirements of different users.

The present invention intends to provide an improved handle to connect at least one resilient rope whose tension force can be adjusted to meet the different requirements of users.

SUMMARY OF THE INVENTION

In accordance with one aspect of the present invention, a handle assembly is provided and comprises a ring-shaped handle that has at least two tapered passages defined radially therethrough. Each tapered passage has a large-diameter portion defined in the inside of the handle and a small-diameter portion defined in the outside of the handle. A locking device has a teardrop component that is sized to be movably inserted in the large-diameter portion and securely engaged with the portion of the tapered passage with the smaller diameter. The teardrop member has a shank extending therefrom, and the shank has a collar connected thereto. A clamping member has a head movably retained in the collar and the head has a tail extending therefrom so as to be movably engaged with the collar.

The object of the present invention is to provide an adjustment capability for a handle assembly for an exercise device and the resilient rope between two handles.

Another object of the present invention is to provide a handle assembly that has at least two tapered passages for a resilient rope to extend therethrough so that the rope in the tapered passages can be secured by a locking device.

Further objects, advantages, and features of the present invention will become apparent from the following detailed description with appropriate reference to the accompanying drawings.

DETAILED DESCRIPTION OF THE PREFERRED EMBODIMENTS

Figure 1:
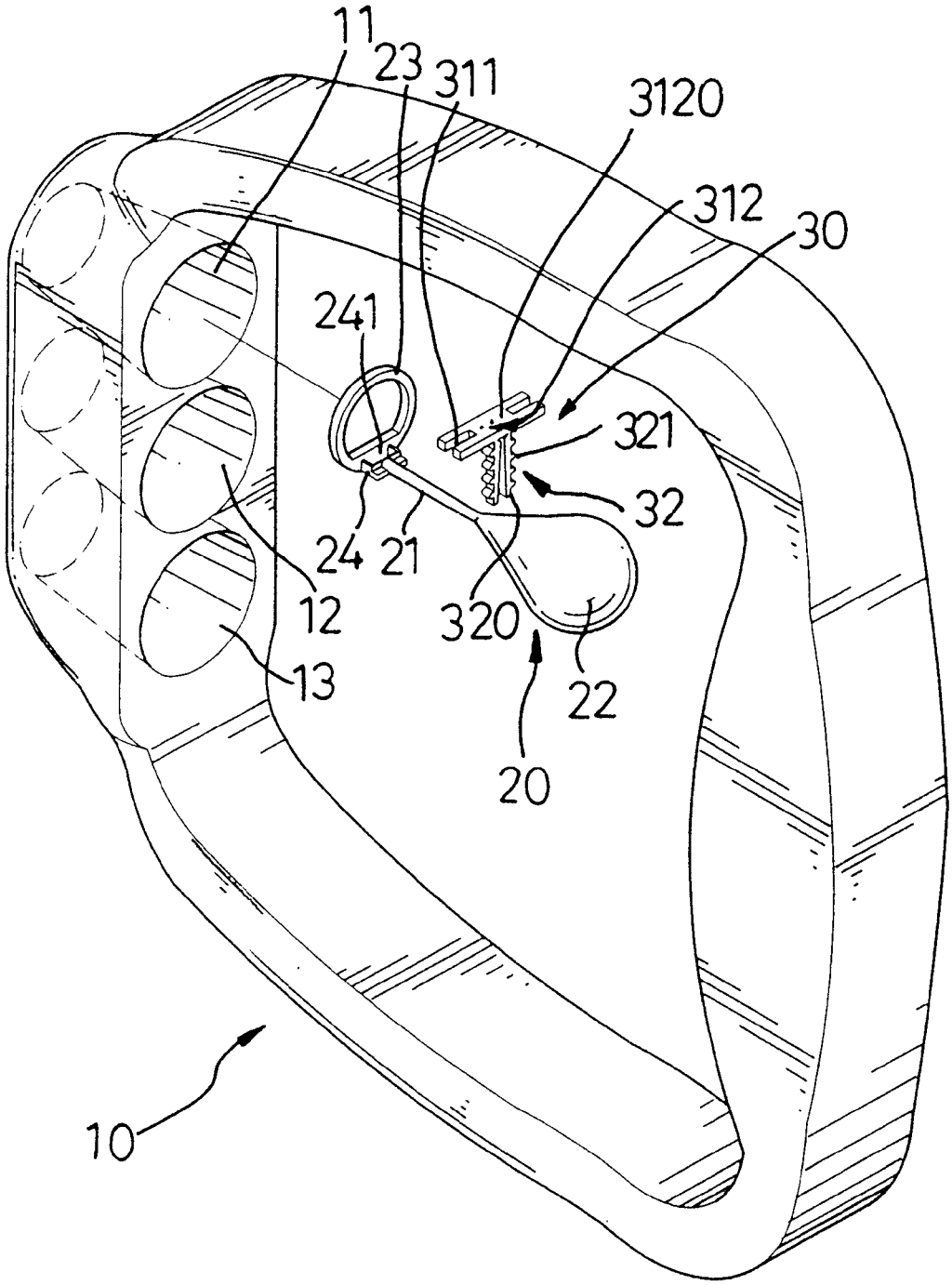
FIG. 1 a perspective view of the handle assembly in accordance with the present invention.
Figure 2:
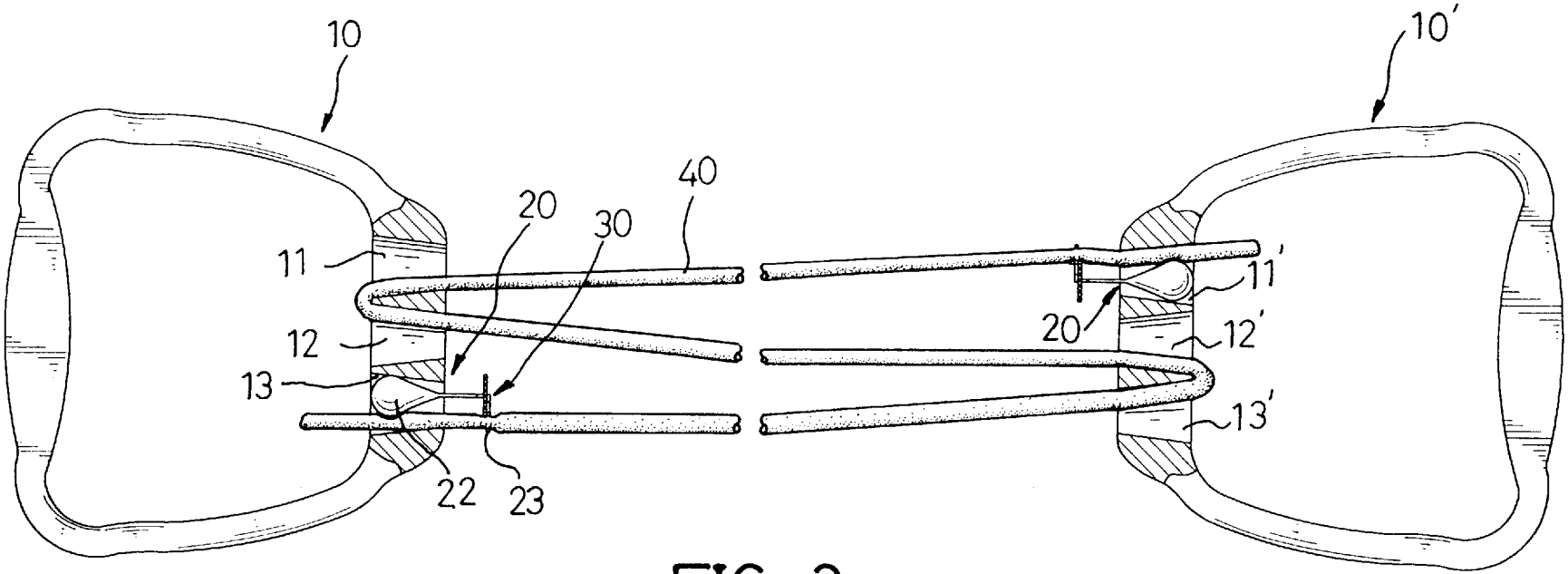
FIG. 2 is a side elevational view, partly in section, of the first embodiment of two handles in accordance with the present invention with a resilient rope connected therebetween.

Referring to FIGS. 1 and 2, the handle assembly in accordance with the present invention comprises a ring-shaped handle (10) having three tapered passages (11, 12, 13) defined radially therethrough, each tapered passage (11, 12, 13) having a large diameter opening defined in the inside of the handle (10) and a small diameter opening defined in the outside of the handle (10).

A locking device (20) has a teardrop member (22) that is sized to be inserted in the large diameter opening and securely engaged the portion of the tapered passage (11, 12, 13) with the smaller diameter. The teardrop member (22) has a shank (21) extending therefrom, and the shank (21) has a collar (23) connected thereto. A frame (24) is connected between the collar (23) and the shank (21), and an aperture (241) is defined through the frame (24).

A clamping member (30) has a head (312) movably retained in the collar (23), and the head (312) has a tail (32) extending therefrom. The head (312) has two slots (3 11) defined in two ends thereof so as to engage with the collar (23), and the tail (32) includes two legs (320) with a gap defined between the two legs (320). Each leg (320) has a plurality of teeth (321) defined in the outside thereof so as to be engaged with the periphery defining the aperture (241). The head (312) further has a plurality of protrusions (3120) extending therefrom so that a resilient rope (40) passes through the collar (23) and is engaged by the head (312) of the clamping member (30).

When in use, the resilient rope (40) is connected between two handles (10, 10') of the present invention, wherein the resilient rope (40) extends through the passage (11') of the handle (10') and passes in sequence through the passage (11) of the handle (10), the passage (12) of the handle (10), the passage (12') of the handle (10'), the passage (13') of the handle (10') and the passage (13) of the handle (10). A locking device (20) has its teardrop member (22) securely engaged with the passage (11') of the handle (10') to securely hold the first end of the resilient rope (40). Another locking device (20) is used to securely hold the second end of the resilient rope (40) in another passage (13) of the handle (10). Accordingly, the tension force of the resilient rope (40) can be adjusted by loosening or tightening either end of the resilient rope (40). Furthermore, the length of the resilient rope (40) between the two handles (10, 10') can also be adjusted to meet the requirement of different users.

Figure 3:
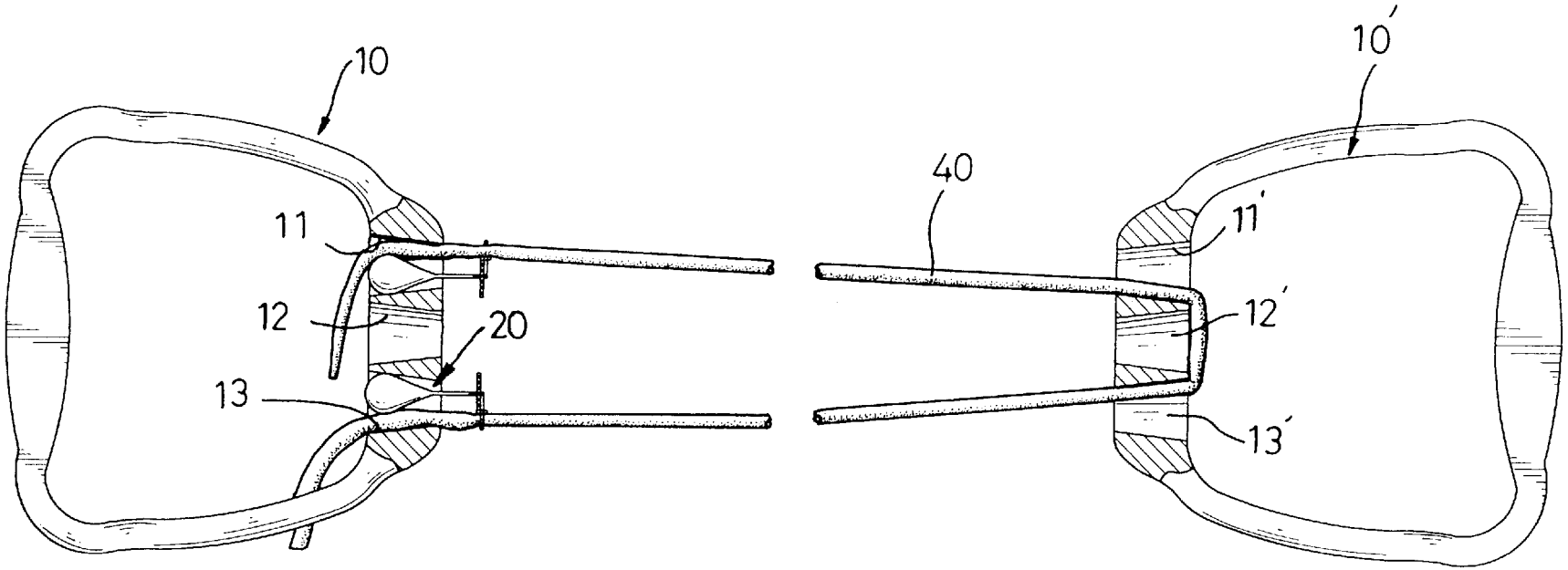
FIG. 3 is a side elevational view, partly in section, of a second embodiment of two handles in accordance with the present invention with a resilient rope connected therebetween.

Referring to FIG. 3, the two ends of the resilient rope (40) may respectively extend through the passages (11, 13) of the handle (10) and two locking devices (20) are respectively engaged with the two passages (11, 13) to secure the two ends of the resilient rope (40) in the two passages (11, 13). For the other handle (10'), the resilient rope (40) passes through the two passages (11', 13'). The tension force of the resilient rope (40) in FIG. 4 is less than that shown in FIG. 2.

Figure 4:
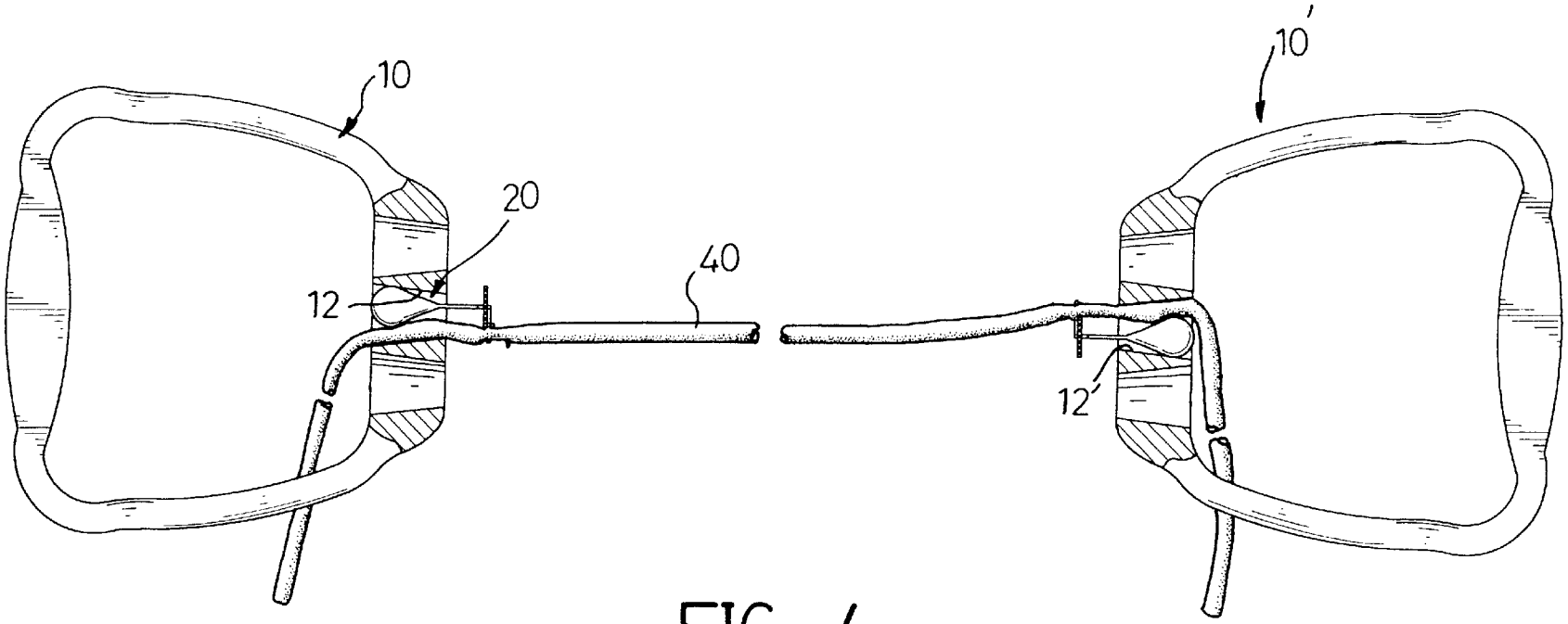
FIG. 4 is a side elevational view, partly in section, of a third embodiment of two handles in accordance with the present invention with a resilient rope connected therebetween.
Figure 5:
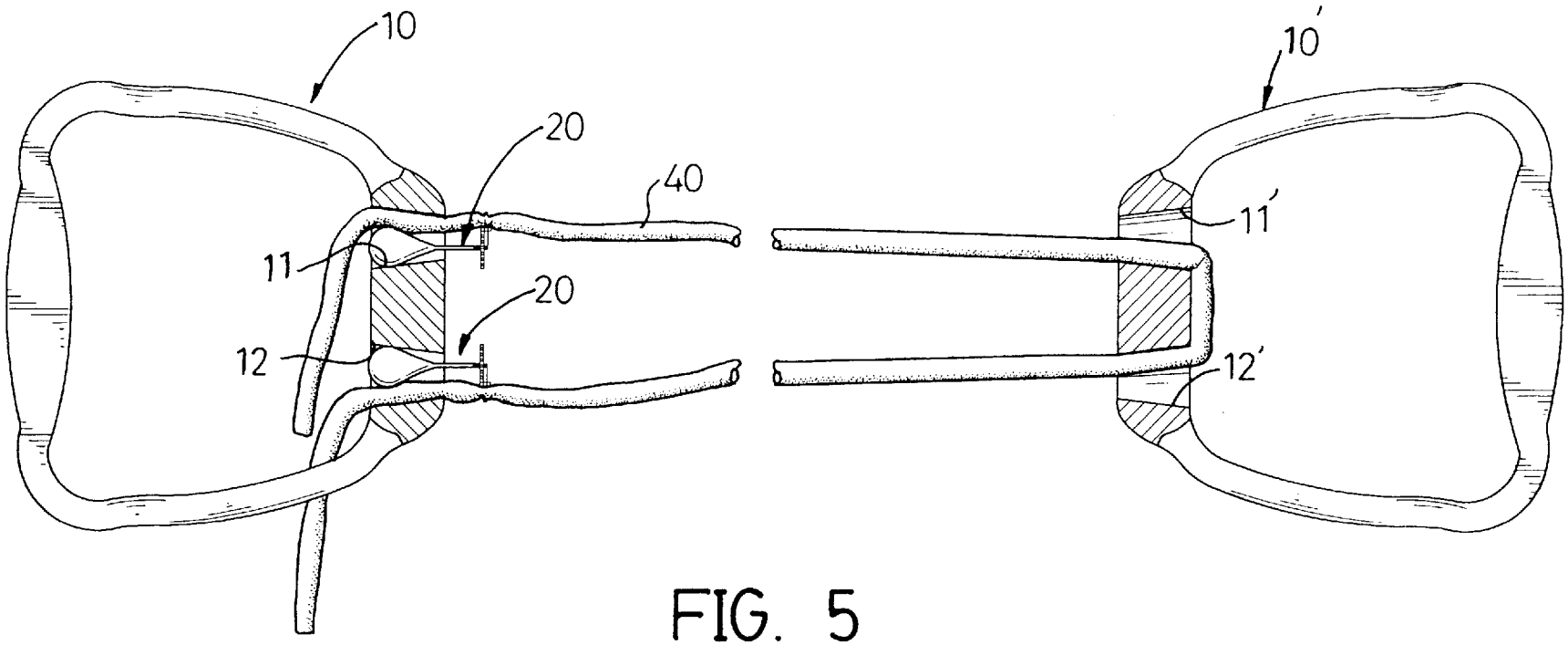
FIG. 5 is a side elevational view, partly in section, of a fourth embodiment of two handles in accordance with the present invention with a resilient rope connected therebetween.

FIG. 4 shows the two ends of the resilient rope (40) respectively securely held in the passage (12) of one handle (10) and the passage (12') of the other handle (10'). FIG. 5 shows each handle (10) has only two tapered passages (I1, 12), and the two ends of the resilient rope (40) are respectively securely held in the two passages (11, 12) of the handle (10) by two locking devices (20). The resilient rope (40) passes through the two passages (11', 12') in the other handle (10').

Figure 6:
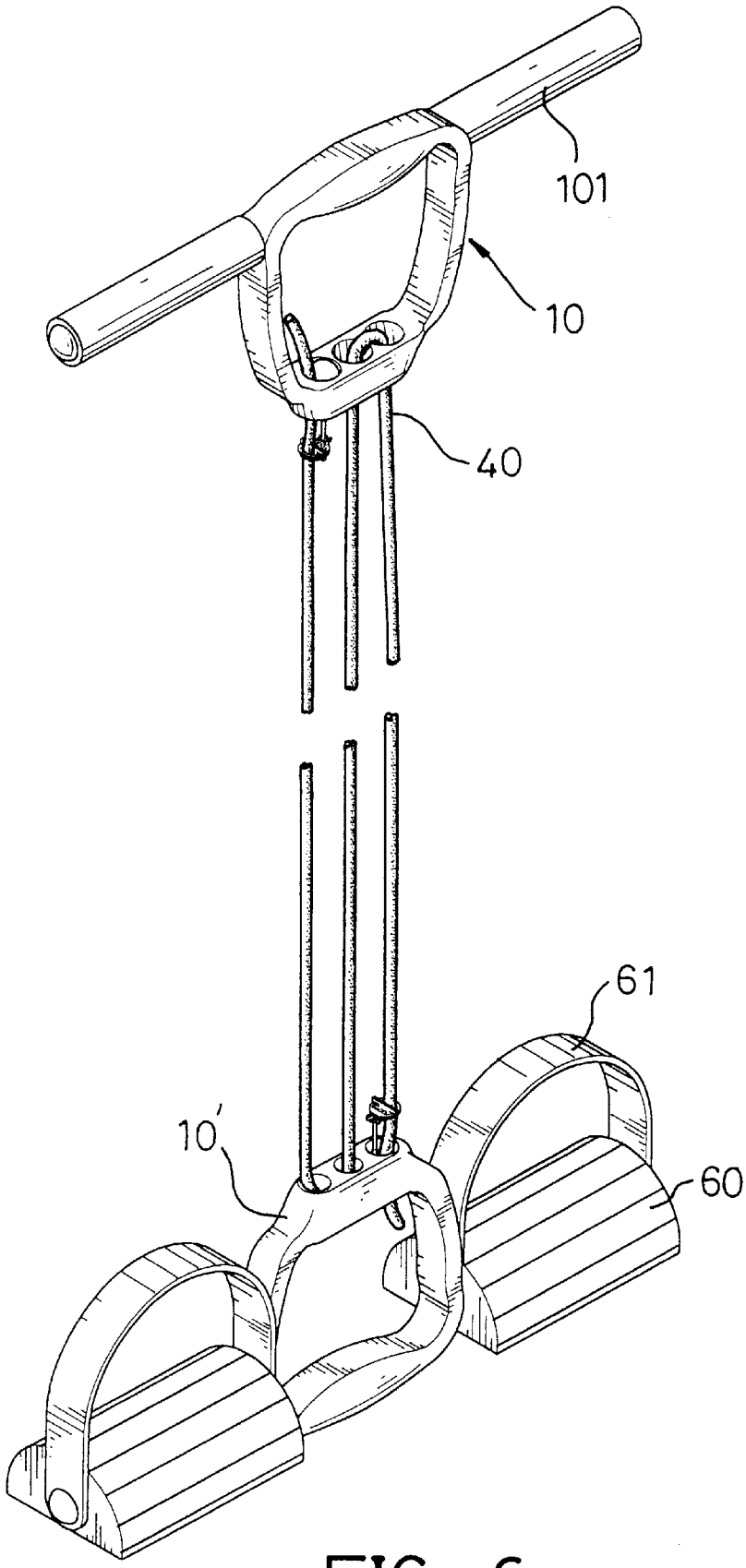
FIG. 6 is a side elevational view, partly in section, of a fifth embodiment of two handles in accordance with the present invention with a resilient rope connected therebetween.

FIG. 6 shows that one handle (10) has a rod (101) extending from each side thereof, and the other handle (10') has a step member (60) connected to each side thereof with each step member (60) having a retaining belt (61). A resilient rope (40) is connected between the two handles (10, 10'). A user places both feet in the two step members (60) and two hands hold the two rods (101) and pull the rods (101) upward.

Figure 7:
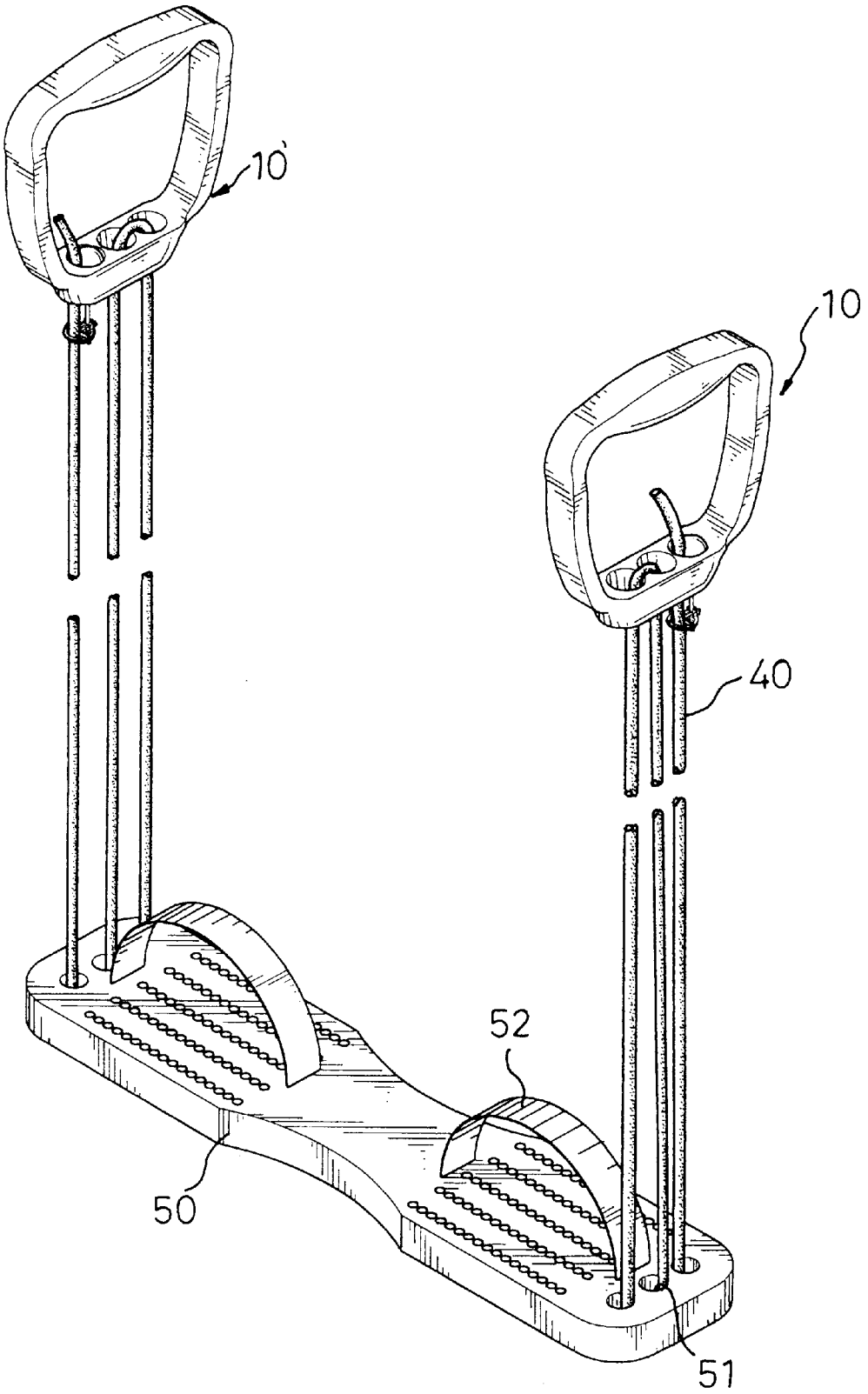
FIG. 7 is a side elevational view, partly in section, of a sixth embodiment of two handles in accordance with the present invention with a resilient rope connected therebetween.

FIG. 7 shows a base member (50) having two foot retaining belts (52) connected to the top thereof and each of the two ends of the base member (50) has three holes (51) defined therethrough. Two handles (10, 10') each have a resilient rope (40) connected thereto, and the other end of each of the resilient ropes (40) is secured in the holes (51) in the base member (50).

The means of connecting the resilient rope (40) to the handle (10/10') in accordance with the present invention and the length of the resilient ropes (40) between the two handles (10, 10') allow the user to adjust the resilient rope (40) according to his/her needs.

Although the invention has been explained in relation to its preferred embodiment, it is to be understood that many other possible modifications and variations can be made without departing from the spirit and scope of the invention as hereinafter claimed.

What is claimed is:

1. A handle assembly comprising:

a ring-shaped handle having at least two tapered passages defined radially through one side thereof, each tapered passage having a large diameter opening defined in the inside of said handle and a smaller diameter opening defined in the outside of said handle, said handle having opposite peripheral side portions each connected to a step member, a locking device having a teardrop member which is sized to be inserted in said large diameter opening and securely engage with said smaller diameter portion of each one of said at least two tapered passages, said teardrop member having a shank extending therefrom and a collar connected to said shank, an aperture being defined between said shank and said collar, and a clamping member having a head movably retained in said collar and said head having a tail extending therefrom so as to be movably engaged with said aperture of said collar.

2. The handle assembly as claimed in claim 1, wherein said head has two slots defined in two ends thereof so as to engage with said collar.

3. The handle assembly as claimed in claim 1, wherein said head has multiple protrusions extending therefrom.

4. The handle assembly as claimed in claim 1, wherein said tail includes two legs, and a gap is defined between said two legs with each leg having multiple teeth defined in the outside thereof so as to be engaged with an edge defining said aperture.

5. The handle assembly as claimed in claim 1 further comprising a frame connected between said shank and said collar, said aperture defined through said frame.

6. The handle assembly as claimed in claim 1, wherein each step member has a foot retaining belt connected thereto.

7. The handle assembly as claimed in claim 1, comprising a second handle connected to said ring-shaped handle, said second handle having a rod connected to each of opposite peripheral side portions thereof.

* * * * *